US009286780B2

(12) United States Patent
Lewiner et al.

(10) Patent No.: US 9,286,780 B2
(45) Date of Patent: Mar. 15, 2016

(54) SMOKE DETECTOR

(75) Inventors: Jacques Lewiner, Saint-Cloud (FR); Stephane Hole, Paris (FR); Zohreh Mokhtari, Issy-les-Moulineaux (FR)

(73) Assignees: FINSECUR, Nanterre (FR); IDSET, Paris (FR)

( * ) Notice: Subject to any disclaimer, the term of this patent is extended or adjusted under 35 U.S.C. 154(b) by 0 days.

(21) Appl. No.: 14/416,786

(22) PCT Filed: Jul. 24, 2012

(86) PCT No.: PCT/FR2012/000304
§ 371 (c)(1),
(2), (4) Date: Jan. 23, 2015

(87) PCT Pub. No.: WO2014/016473
PCT Pub. Date: Jan. 30, 2014

(65) Prior Publication Data
US 2015/0206406 A1 Jul. 23, 2015

(51) Int. Cl.
*G08B 17/00* (2006.01)
*G08B 17/11* (2006.01)

(52) U.S. Cl.
CPC ..... *G08B 17/11* (2013.01)

(58) Field of Classification Search
CPC ..... G08B 17/11; G08B 17/10; G08B 17/12; G08B 17/113; G08B 21/14; G08B 29/183; G01N 15/0656; G01N 27/70; G01N 33/0027
See application file for complete search history.

(56) References Cited

U.S. PATENT DOCUMENTS

| | | | | |
|---|---|---|---|---|
| 3,657,737 | A * | 4/1972 | Hamm | G08B 17/11 250/375 |
| 3,823,372 | A | 7/1974 | Hanson et al. | |
| 3,932,851 | A | 1/1976 | Rayl et al. | |
| 4,488,044 | A * | 12/1984 | Rork | G08B 17/113 250/381 |
| 4,652,866 | A * | 3/1987 | Siegmann | G08B 17/10 324/464 |
| 4,864,141 | A | 9/1989 | Lewiner | |
| 2008/0252473 | A1 * | 10/2008 | Fink | G08B 17/11 340/629 |

FOREIGN PATENT DOCUMENTS

| | | | |
|---|---|---|---|
| DE | 4402518 | A1 | 8/1995 |
| EP | 0236223 | A1 | 9/1987 |
| EP | 1005005 | A2 | 5/2000 |
| FR | 2594953 | A1 | 8/1987 |
| FR | 2746184 | A1 | 9/1997 |
| FR | 2971354 | A1 | 8/2012 |

* cited by examiner

*Primary Examiner* — Kerri McNally
*Assistant Examiner* — Renee Dorsey
(74) *Attorney, Agent, or Firm* — Im IP Law PLLC; C. Andrew Im

(57) ABSTRACT

A smoke detector includes a drift chamber and an ionization chamber formed by a first electrode and a second electrode. Electric charges are generated by ionization of the air. The drift chamber separated from the ionization chamber by the second electrode. The smoke particles penetrates from the environment to a detector inside the drift chamber. The electrical potential of first electrode exceeds a critical electric potential value for generating a corona discharge in the vicinity of the first electrode. The second electrode has openings for the electric charges generated in the ionization chamber to move to the drift chamber. The electric potential of the second electrode allows the electric charges in the drift chamber to move from the second electrode to the third electrode. The electric field between the second and third electrodes is at least 100 times weaker than the electric field between the first and second electrodes.

15 Claims, 4 Drawing Sheets

SMOKE DETECTOR

RELATED APPLICATIONS

This application is a §371 application from PCT/FR2012/000304 filed Jul. 24, 2012, which is herein incorporated by reference in its entirety.

TECHNICAL FIELD OF THE INVENTION

The present invention relates to a smoke detector, a device for detecting smoke and a method for detecting smoke. It applies, in particular, to detecting a fire by means of the presence of fine particles or aerosols contained in the smoke, which makes it possible to reduce fire risks in premises where such devices are installed or where such methods are implemented.

BACKGROUND OF THE INVENTION

Two physical effects are mainly used to detect the presence of smoke, namely the scattering of light by the smoke, dust or aerosols associated with it; and the change in the movement speed of ions driven by an electric field as a result of this smoke, dust or aerosols.

The devices that exploit the second effect by using air ionization are more sensitive to combustion products, emitted during the initial development of fires or in hot fires; the size of these products can reach values of several tens of nm, or less, and thus allow alarms to be triggered earlier than optical devices. As a result, these detectors make it possible to limit the consequences of these fires.

An ionic smoke detector comprises a chamber in which two measurement electrodes are arranged between which qi charged ions are created or brought.

Applying a potential difference between these electrodes produces an electric field E that exerts a force $F=qi\times E$ on these ions, which produces a nominal electric current between the electrodes and in the external circuit that connects them. This electric current is dependent in particular on the quantity of ions present in the chamber, the potential difference applied between the measurement electrodes, and the mobility of the ions.

Means of measuring this current are also provided, which supply a signal that can be used by processing means.

When particles associated with smoke enter the chamber, some of these particles attach to the chamber's ions as a result of the electrostatic forces created by these ions, which reduces their mobility and has the effect of reducing the electric current.

If the voltage applied to the electrodes is low enough, typically between 5 and 30 volts, the nominal electric current is also low, typically between 10 pA and 100 micro-amperes, and the slowing down of the ions resulting from the presence of the particles is such as to reduce the amplitude of this current very substantially.

The processing means are arranged so as to allow an alarm to be triggered or sent when the current measured is below a predefined threshold.

Two approaches have been used to create ions in the measurement chamber, either by ionizing the air using a small radioactive source, as described, for example, in patent FR 86 02567, or by creating an electric field stronger than the electric field for air breakdown, as described, for example, in U.S. Pat. No. 3,823,372.

The first approach is simple to implement and not very costly.

For example, a source of α particles comprised of Am-241 with activity between 0.1 and 1 microcurie is used, these particles being able to cross a distance of the order of centimeters in the air and thus ionize the volume passed through.

However, although this solution makes it possible to detect fires early and thus reduce their consequences, it is facing increasing challenges, either from users themselves, who are reluctant to find increased numbers of radioactive sources in their premises, or from manufacturers' sales departments, who are confronted by negative reactions from their customers, or from regulations.

With regards to the second approach, various solutions have been proposed for ionizing the air.

They use the fact that, by applying a potential difference above a certain threshold Vs between two electrodes, one can initiate a process of electrical discharge and thus create ions.

The value Vs depends on several parameters, such as the nature of the gas between the electrodes, the pressure of the gas separating them, the distance between the electrodes and their shape, the presence of dust or humidity, etc.

In the air, this threshold is considered to be approximately 330V for distances between electrodes of the order of micrometers, distances too small to be used directly in a smoke detector, which means that voltages of several kilovolts must be used to create this ionization.

However, values such as these cannot be used for polarizing the measurement electrodes since the high speed of the ions resulting from this would lead to a very high nominal electric current and these ions would cross the measurement chamber in a very short period of time.

As a result, the changes in this current because of the presence of particles associated with smoke would be so small that they would be difficult to detect.

To overcome this obstacle, various proposals have been made using a measurement chamber polarized by a weak voltage, and thus having a low nominal current.

A first approach has been to use a measurement chamber polarized by a weak voltage, into which ions produced in an ionization chamber polarized by a high voltage are transferred by means of a weak current of air, and thus to have a low nominal current.

An example of such a solution is described in patent FR 96 03296.

In a second approach, reflective elements have been introduced between the electrodes of an ionization chamber polarized by a high voltage, so as to increase the interaction time.

An example of such a solution is described in U.S. Pat. No. 3,932,851.

These alternative solutions, however, result either in detectors that have relatively low detection sensitivities due to the very fact of using high voltages, significantly reducing their advantages, or in devices that are mechanically complex, fragile and expensive.

In addition, the response of these detectors is also influenced by parameters such as variations in ambient gas pressure or in temperature, thus requiring compensation devices to be used as well, such as described in patent EP-236223, for example.

For these reasons there have been no major industrial-scale developments of these alternative solutions.

OBJECT AND SUMMARY OF THE INVENTION

The aim of this invention is to remedy these drawbacks.

To this end, according to a first aspect, this invention envisages a smoke detector comprising: an ionization chamber, formed by a first electrode and a second electrode, in which electrical charges are likely to be generated by ionization of the air; a drift chamber separate from the ionization chamber and separated from the ionization chamber by the second electrode, the drift chamber being formed by the second electrode and a third electrode and being suitable for allowing smoke particles from the detector environment to enter the interior of the drift chamber; the first electrode being able to be brought to an electric potential, relative to the second electrode, exceeding a critical electric potential value suitable for generating a corona effect, wherein discharges ionizing the air in the ionization chamber are generated, in the vicinity of the first electrode; the second electrode being provided with apertures allowing the electric charges generated in the ionization chamber to pass from the ionization chamber towards the drift chamber; the second electrode being able to be brought to an electric potential, relative to the third electrode, allowing the electric charges that entered into the drift chamber to move from the second electrode towards the third electrode, the electric field created between the second electrode and the third electrode being at least 100 times weaker than the electric field created between the first electrode and the second electrode; the detector comprising in addition a measurement device for measuring an electrical magnitude representative of the speed of movement of the electrical charges between the second electrode and the third electrode to trigger an alarm when this electrical magnitude undergoes an abnormal change.

A second aspect of the present invention envisages a method for detecting smoke comprising: applying an electric potential between a first electrode and a second electrode that exceeds a critical electric potential value suitable for generating a corona effect in the vicinity of the first electrode, wherein discharges are generated that ionize the air in an ionization chamber formed between the first electrode and the second electrode; applying an electric potential between the second electrode and a third electrode that allows the electric charges generated by ionizing the air in the ionization chamber, which entered into the drift chamber through the second electrode, to move from the second electrode towards the third electrode, the electric field created between the second electrode and the third electrode being at least 100 times weaker than the electric field created between the first electrode and the second electrode; measuring an electrical magnitude representative of the speed of movement of the electrical charges between the second electrode and the third electrode to trigger an alarm when the electrical magnitude undergoes an abnormal change.

A third aspect of the present invention envisages a device for detecting smoke comprising a first smoke detector according to the first aspect of the invention and a second smoke detector according to the first aspect of the invention, and wherein the ionization chamber and the drift chamber of the second detector are closed to the entry of smoke particles and are suitable for allowing air from the environment of the first detector to enter, the electrical magnitude of the second detector being usable as a reference signal for correcting the physical magnitude of the first detector for triggering the alarm.

In preferred embodiments of the invention, possibly one and/or the other of the following layouts can also be used:

- the first electrode is able to be brought to a negative electric potential relative to the second electrode, the second electrode allowing the electrons generated in the ionization chamber to pass and being able to be brought to a negative electric potential relative to the third electrode;
- the measuring device is configured to measure the electrical current generated between the second electrode and the third electrode;
- the first electrode, the second electrode and the third electrode are positioned substantially parallel to each other;
- the third electrode is arranged so as to surround the second electrode, the second electrode being arranged so as to surround the first electrode;
- the second electrode and the third electrode are each cylindrical in shape, and the first electrode is positioned parallel to the axis of the cylinders;
- the first electrode comprises a conductive wire;
- the diameter of the first electrode is of the order of 5 μm to 30 μm;
- the first electrode can to be brought to a voltage of the order of −1 kV to −4 kV;
- the second electrode can to be brought to an electric voltage of −2V to −20V;
- the distance between the first electrode and the second electrode is 1 to 8 mm and the distance between the second electrode and the third electrode is 5 to 30 mm;
- the ionization chamber is closed by a metal cover.

BRIEF DESCRIPTION OF THE DRAWINGS

In the following, descriptions are provided for some preferred embodiments of the invention with reference to the figures in an appendix hereto, in non-limiting fashion, of course.

DETAILED DESCRIPTION OF THE EMBODIMENTS

Figure 1A:
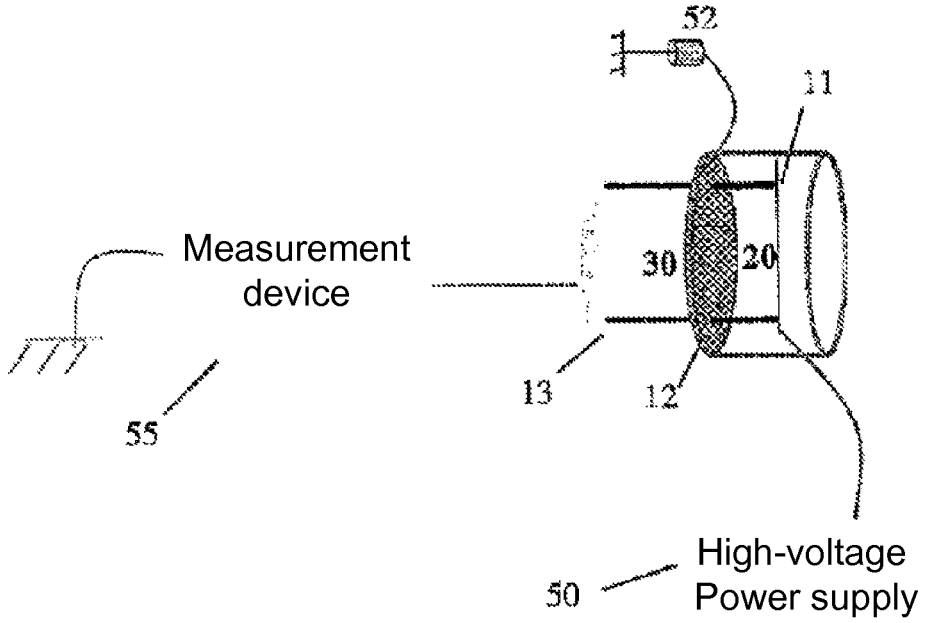
FIG. 1A represents, schematically, elements of a smoke detector according to a first embodiment of the present invention.
Figure 1B:
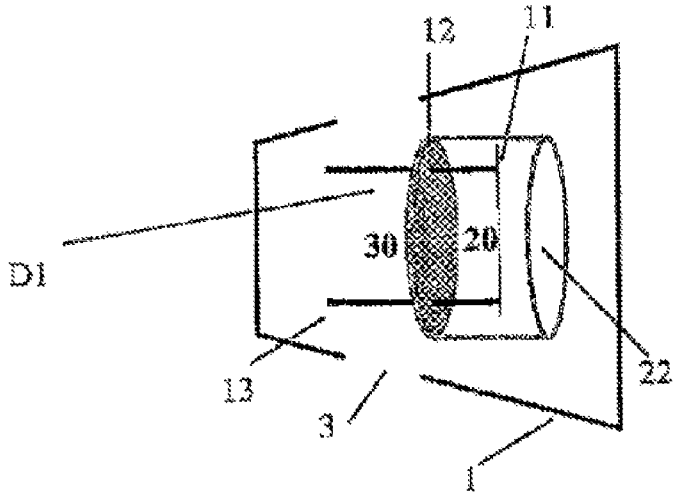
FIG. 1B represents, schematically, a smoke detector according to a first embodiment of the present invention.

A smoke detector according to a first mode of the invention is represented schematically in FIGS. 1A and 1B. This smoke detector comprises a chamber 1 fitted, in a manner know per se, with apertures 3 to allow the air and smoke particles to be inspected to pass through a detection zone D1 inside the chamber 1. In the chamber a first electrode 11, a second electrode 12 and a third electrode 13 are positioned, placed substantially parallel with respect to each other. An ionization chamber 20, in which electrical charges are likely to be generated, is delimited between the first electrode 11 and the second electrode 12. A drift chamber 30, forming a detection zone in which the smoke particles can be detected, is delimited between the second electrode 12 and the third electrode 13. Thus, the second electrode 12 separates the ionization chamber 20 from the drift chamber 30.

The first electrode 11 is formed from a conductive wire, such as a 5 μm to 25 μm diameter wire made of tungsten covered with gold. The wire 11 of the first electrode is insulated from the rest of the detector by insulating bars.

The ionization chamber 20 is closed by a metal cover 22 so as to be protected from electromagnetic noise. The drift chamber 30 is open to receive smoke particles from outside the detector through apertures 3.

The second electrode 12 is formed of a wire mesh. In this embodiment, the mesh has a pitch of 0.28 mm between the wires, and the wires have a diameter of about 100 μm.

In a variant, the second electrode can be formed of a conductive plane provided with holes.

The third electrode 13 is, for example, formed of a copper disk with a radius of 50 mm.

The distance between the first electrode 11 and the second electrode 12 can be 1 to 8 mm and the distance between the second electrode 12 and the third electrode 13 can be 5 to 30 mm. In this embodiment, the distance between the first electrode 11 and the second electrode 12 is approximately 5 mm and the distance between the second electrode 12 and the third electrode 13 is approximately 20 mm.

The first electrode 11 is connected to a high-voltage power supply 50 suitable for supplying a high voltage of the order of −1 kV to −4 kV to the first electrode 11.

The second electrode 12 is connected to a low-voltage power supply 52 suitable for supplying a low voltage of the order of +2V to −20V to the second electrode 12. In this embodiment, the second electrode 12 is connected to a 9V battery so as to have a stable voltage over the mesh 12.

The third electrode 13 is connected to the ground via an electrometer 55 suitable for measuring the current, in a manner known per se, between the second electrode 12 and the third electrode 13. Thus, the third electrode 13 forms a measurement electrode.

In such an arrangement, a strong electric field is generated in the ionization chamber 20 between the first electrode 11 and the second electrode 12, and more specifically in the vicinity of electrode 11, and a weak electric field—approximately 200-300 times weaker than the electric field generated in the ionization chamber 20—is generated in the drift chamber 30 between the second electrode 12 and the third electrode 13.

The high negative voltage applied to the wire of the first electrode 11 exceeds a critical value suitable for generating in the vicinity of the wire 11 a corona effect around the wire 11, wherein discharges ionize the air in the chamber, creating electrical charges consisting of ions and electrons.

The electrons generated in this way follow the electric field towards the mesh 12. A portion of these electrons is absorbed by the mesh 12, and another portion passes through the mesh 12 to reach the drift chamber 30. The electrons thus transferred into the drift chamber 30 are subjected to the electrostatic field present in the drift chamber 30 between the mesh 12 and the measurement electrode 13. This field attracts the electrons contained in the drift chamber 30 towards the measurement electrode 13 such that an electrical current is generated between the mesh 12 and the measurement electrode 13. This electric field in the drift chamber 30 is controlled by the voltage applied to the mesh 12 relative to the measurement electrode 13. As this voltage is fairly low, the speed of the electrons that enter the drift chamber 30 is low, which makes it possible to have a time of interaction between the charged particles in movement in the drift chamber and the smoke particles that is longer than that obtained in smoke detectors with no radioactive source and no drift chamber. It can be seen that this time is comparable to that observed in ionization smoke detectors using radioactive sources to generate these charged particles.

If there is no smoke in the drift chamber, the amperage of the electrical current measured by the electrometer 55 will be of a value indicative of a normal situation.

When particles associated with smoke enter the drift chamber 30, some of these particles attach to the electrons of the drift chamber 30 as a result of the electrostatic forces created by these electrons, which reduces their mobility and has the effect of reducing the electric current measured by the electrometer 55. The decrease in the electrical current thus represents an abnormal change indicative of the presence of smoke.

When the absolute value of the electrical current measured by the electrometer 55 drops below a certain threshold, an alarm reaction is triggered on an output connected for example to an alarm control unit or a local alarm.

Figure 2:
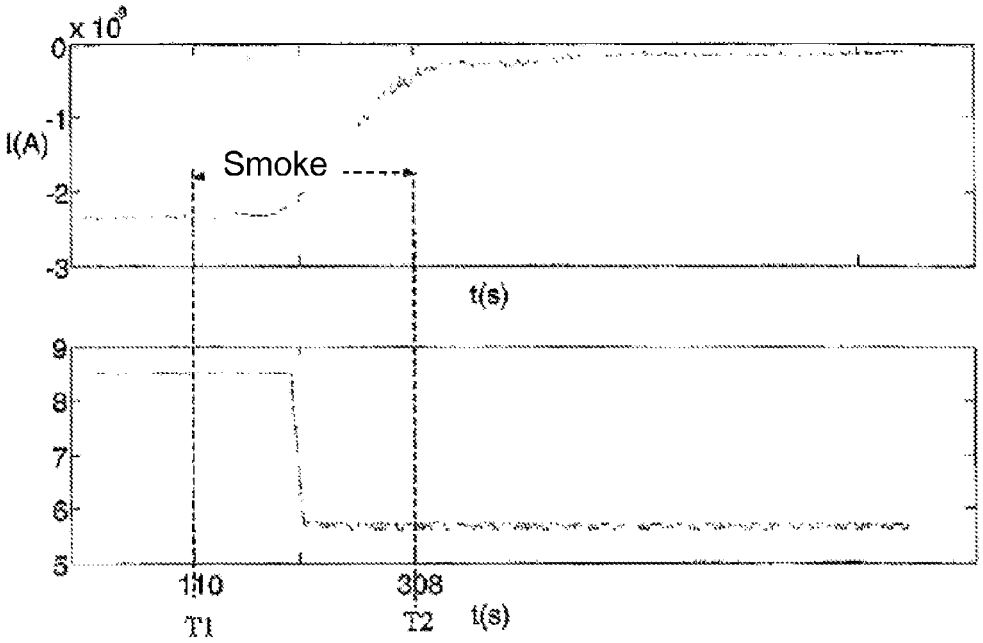
FIG. 2 represents, graphically, an example comparing the response as a function of time t of a smoke detector according to an embodiment of the invention and a commercial smoke detector utilizing the scattering of light by the smoke.
Figure 3:
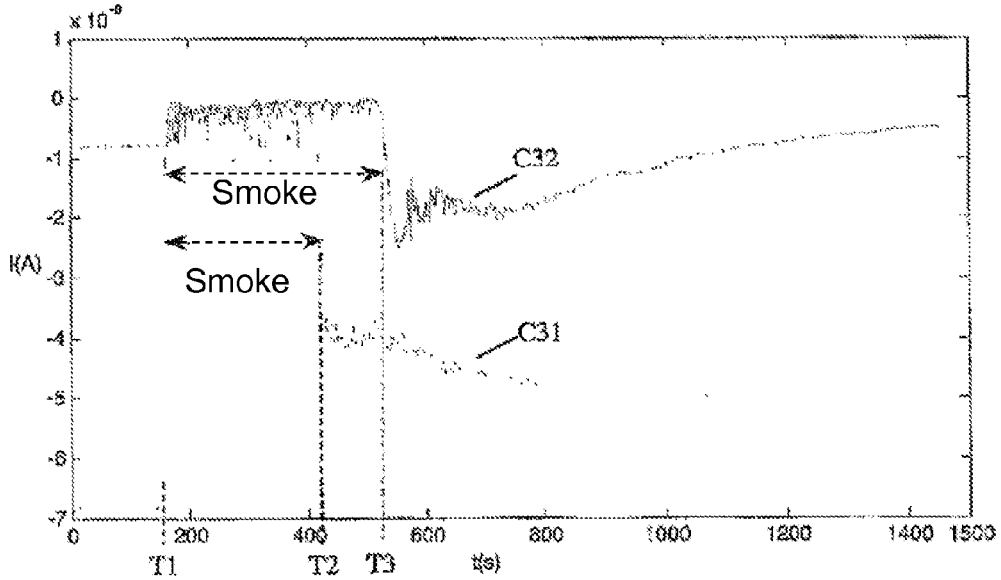
FIG. 3 represents, graphically, an example of the response as a function of time t of the smoke detector, in the presence and absence of smoke, according to an embodiment of the invention for different diameters of the wire forming the first electrode.

To have an idea of the change in the current due to the smoke, one can refer to FIGS. 2 and 3 to compare the current before and after smoke has been sent into the detector in an example of a test of the detector. In FIG. 2 the smoke enters the detector from time t=T1 through to time t=T2. The top of FIG. 2 shows that under a voltage of −3.5 kV the current, of an absolute value of the order of 2.5 nA without smoke, is reduced to 100 pA in the presence of smoke.

In this example, the amplitude of the current decreases by a factor of ten.

In order to optimize the performance of the detector, some parameters of the detector can be adjusted, for example the diameter of the wire of the first electrode 11. In effect, the smaller the diameter of this wire, the lower the voltage applied to the first electrode 11 needs to be so as to be able to trigger the corona effect. For this given voltage, applied to the first electrode 11, the reduction in the radius of the wire in reflected by an increase in the absolute value of the current, as can be seen in FIG. 3. Under a voltage of −2.2 kV, a 10 μm wire (curve C31) generates a current substantially 10 times stronger than a 25 μm wire (curve C32). In the presence of smoke, the signal is similar (amplitude of approximately 0.10 nA) in both cases.

Figure 4:
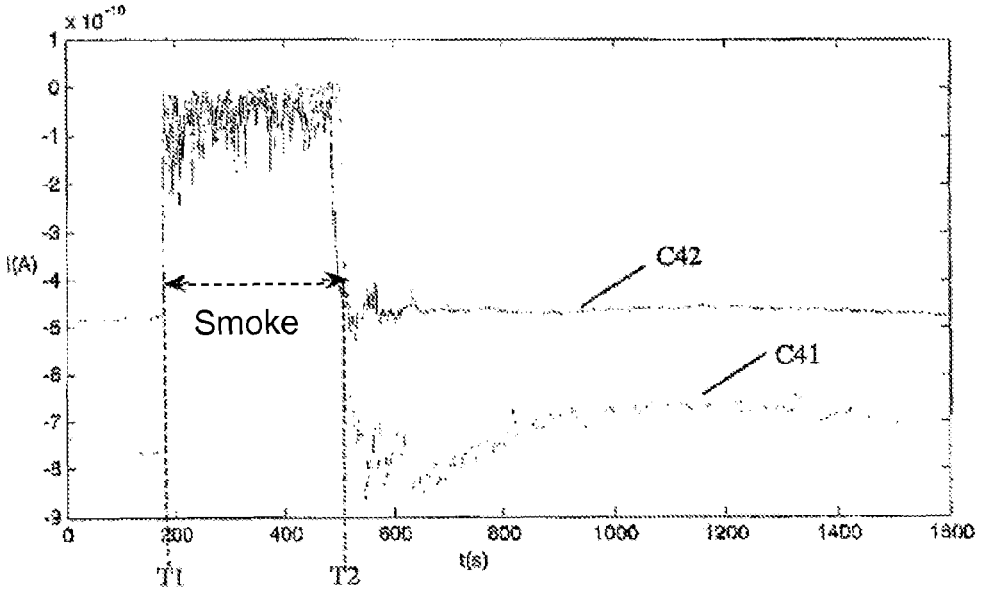
FIG. 4 represents, graphically, an example of the response as a function of time t of the smoke detector, in the presence and absence of smoke, according to an embodiment of the invention for different distances between the second electrode and the third electrode.

Depending on the objectives sought, another parameter that can be optimized is the distance between the mesh 12 and the measurement electrode 13, which can typically be between 5 mm and 30 mm. The influence of this distance is shown in FIG. 4. In this figure can be observed the results of two experiments carried out in the same way by changing only the distance between the mesh 12 and the measurement electrode, which is 8 mm in one case (curve C41) and 10 mm in another case (curve C42). As can be expected, the absolute value of the current without smoke is greater when the distance between the mesh 12 and the measurement electrode 13 is smaller, since the drift field is stronger.

Thanks to these provisions, firstly, it is no longer necessary to use a radioactive source to ionize the air, and secondly the probability of detecting smoke particles is increased as a consequence of the reduced speed of the electrons in the drift chamber 30, which has the effect of thus increasing the time for the smoke that enters the drift chamber 30 to react with these electrons.

Figure 5A:
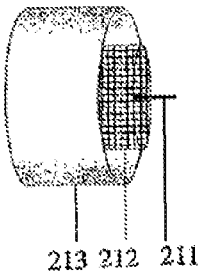
FIGS. 5A to 5C represent, schematically, elements of a smoke detector according to a second embodiment of the present invention, respectively in perspective, in an axial cross-section view and in a longitudinal cross-section view.

Elements of a smoke detector according to a second mode of the invention are represented schematically in FIGS. 5A and 1B. As with the smoke detector according to the first embodiment, the smoke detector according to the second embodiment comprises a chamber 1 fitted, in a manner know per se, with apertures 3 to allow the air and smoke particles to be inspected to pass through a detection zone D2 inside the chamber. In this second embodiment, the general structure of the detector has a geometry of revolution. A wire 211 forming a first electrode is held inside an ionization chamber, which is itself delimited by a cylindrically-shaped mesh 212 that forms the second electrode. The wire 211 extends parallel to the axis of the cylinder defined by the second electrode 212. A third electrode 213, which forms a measurement electrode 213, is cylindrical in shape and surrounds the second electrode 212 and the first electrode 211. A drift chamber 230 comprising the detection zone D2 is comprised between the second electrode 212 and the third electrode 213.

The distances between the first electrode and the second electrode, and between the second electrode and the third electrode presented above for the first embodiment can be applied to this second embodiment.

Similarly, the high electrical voltage applied to the first electrode and the electrical voltages applied to the second electrode, and to the third electrode as presented above for the first embodiment can be applied to electrodes 211, 212, 213 of this second embodiment such that a strong electric field is generated in the ionization chamber 220 between the first electrode 211 and the second electrode 212, and more specifically in the vicinity of electrode 211, and a weak electric field—approximately 200-300 times weaker than the electric field generated in the ionization chamber 220—is generated in the drift chamber 230 between the second electrode 212 and the third electrode 213.

The high negative voltage applied to the wire forming the first electrode 211 exceeds a critical value suitable for generating a corona effect in the vicinity of this wire 211, wherein discharges ionize the air, creating electrical charges consisting of ions and electrons.

The electrons generated in this way follow the electric field towards the mesh 212. A portion of these electrons is absorbed by the mesh 212, and another portion passes through this mesh 212 to reach the drift chamber 230. The electrons thus transferred into the drift chamber 230 are then subjected to the electrostatic field reigning in the drift chamber 230 between the mesh 212 and the measurement electrode 213. This field draws the electrons contained in the drift chamber 230 towards the measurement electrode 213 such that an electrical current is generated between the mesh 212 and the measurement electrode 213. This electric field in the drift chamber 230 is controlled by the voltage applied to the mesh 212 relative to the measurement electrode 213. As this voltage is fairly low, the speed of the electrons that enter the drift chamber 230 is low, which again makes it possible to have a longer time of interaction between the charged particles in movement in the drift chamber and the smoke particles than that obtained in smoke detectors with no radioactive source and no drift chamber. It can also be seen that this time is comparable to that observed in ionization smoke detectors using radioactive sources to generate these charged particles.

If there is no smoke in the drift chamber, the amperage of the electrical current measured by the electrometer will be of a value indicative of a normal situation.

When particles associated with smoke enter the drift chamber 230, some of these particles attach to the electrons of the drift chamber 230 as a result of the electrostatic forces created by these electrons, which reduces their mobility and has the effect of reducing the electric current measured by the electrometer. The decrease in the electrical current thus represents an abnormal change indicative of the presence of smoke. When the electrical current measured by the electrometer drops below a certain threshold, an alarm reaction is triggered on an output connected for example to an alarm control unit or a local alarm.

Figure 5B:
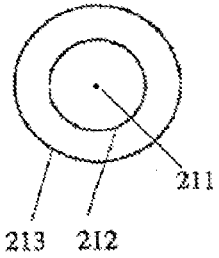
Figure 5C:
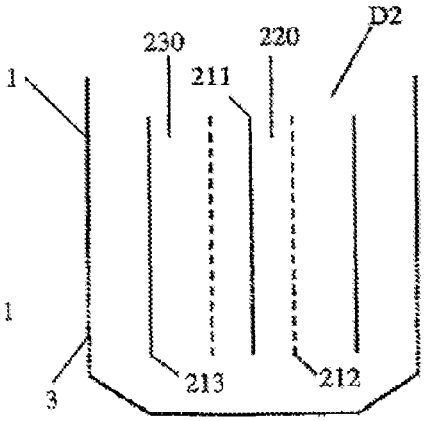
Figure 6:
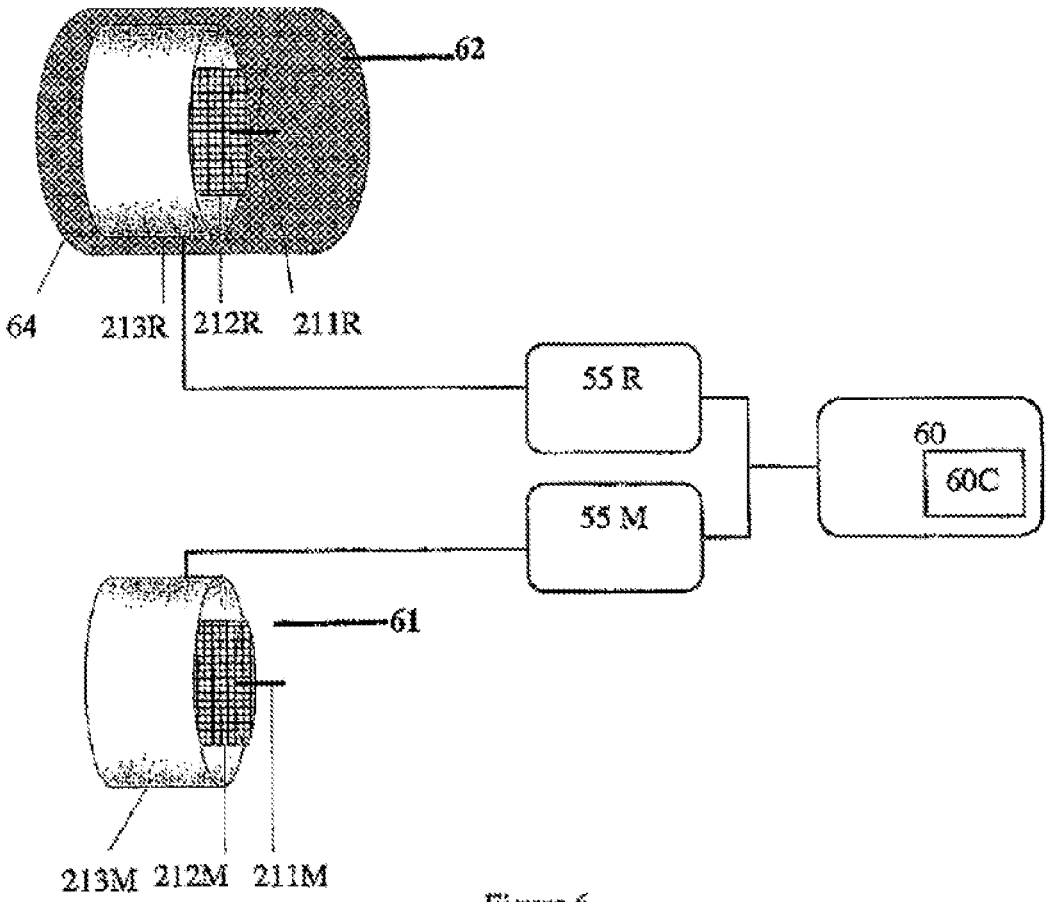
FIG. 6 represents, schematically, elements of a smoke detector device according to a third embodiment of the present invention.

In a third embodiment illustrated in FIG. 6, a detection device comprises two identical detectors according to the second embodiment as described in FIG. 5, arranged such that the smoke particles can enter only one of the two detectors, this detector 61 being referred to below as measurement chamber, but the smoke particles can enter the other detector 62, this second detector being referred to below as reference chamber, and comprising an enclosure 64 suitable for preventing the smoke particles from entering but able to allow the pressures inside and outside this enclosure to be equalized.

Thus, the two chambers are subjected to the same environmental conditions: type of gas, pressure, humidity, etc., but only the measurement chamber can receive the smoke particles.

In a variant, two identical detectors according to the first embodiment as described in FIG. 1 can be used.

In the two variants of this third embodiment, electrodes 11M and 11R or electrodes 211M and 211R, first electrodes of ionization chambers respectively 20M and 20R, and 220M and 220R of the measurement chambers and reference chambers can be combined in a single electrode such that the electrical charges generated by this electrode are drawn towards the measurement chamber and towards the reference chamber.

Means of operation 60 are provided for producing, from the current coming from the reference chamber and determined by the electrometer 55R, a signal representative of the environmental conditions and for correcting accordingly the current coming from the measurement chamber and determined by the electrometer 55M. For example, the means of operation 60 can comprise a unit 60C able to perform a subtraction, for performing a simple subtraction of the reference current measured by the electrometer 55R from the measurement current measured by the electrometer 55M. If there is no smoke, these two currents are substantially equal and the difference is substantially zero.

If there is smoke, the measurement current decreases and the difference between the two currents increases.

If a predefined threshold for this difference is exceeded, the detection device can produce an alarm signal.

It goes without saying, and as is demonstrated moreover in the preceding description, that the invention is in no way restricted to those modes of application and embodiments that have been more particularly envisaged; on the contrary, it encompasses all the variants without in any way departing from the scope of the invention, such as it is defined by the claims.

The invention claimed is:

1. A smoke detector, comprising:

an ionization chamber formed by a first electrode and a second electrode, in which electrical charges are generated by ionization of air;

a drift chamber formed by the second electrode and a third electrode and separated from the ionization chamber by the second electrode, the drift chamber configured to allow smoke particles from a detector environment to enter an interior of the drift chamber;

the first electrode configured to brought to an electric potential, relative to the second electrode, exceeding a critical electric potential value to generate a corona effect in the vicinity of the first electrode, which generates discharges that ionizes the air in the ionization chamber;

the second electrode comprising apertures to enable electric charges generated by the ionization of air in the ionization chamber to move towards the drift chamber, an electric potential of the second electrode, relative to the third electrode, allows the electric charges in the drift chamber to move from the second electrode towards the third electrode, wherein an electric field generated between the second electrode and the third electrode is at least 100 times weaker than an electric field generated between the first electrode and the second electrode; and a measurement device to measure an electrical magnitude representative of speed of electrical charges between the second electrode and the third electrode and to trigger an alarm when a change in the electrical magnitude is below a predetermined threshold.

2. The smoke detector according to claim 1, wherein the first electrode is configured to be brought to a negative electric potential relative to the second electrode; and wherein the second electrode allows electrons generated in the ionization chamber to pass and is configured to be brought to a negative electric potential relative to the third electrode.

3. The smoke detector according to claim 1, wherein the measuring device is configured to measure an electrical current generated between the second electrode and the third electrode.

4. The smoke detector according to claim 1, wherein the first electrode, the second electrode and the third electrode are positioned substantially parallel to each other.

5. The smoke detector according to claim 1, wherein the third electrode surrounds the second electrode surrounding the first electrode.

6. The smoke detector according to claim 5, wherein the second electrode and the third electrode are each cylindrical in shape; and wherein the first electrode is positioned parallel to an axis of the cylindrical shapes.

7. The smoke detector according to claim 5, wherein the diameter of the first electrode is between 5 μm and 30 μm.

8. The smoke detector according to claim 1, wherein the first electrode comprises a conductive wire.

9. The smoke detector according to claim 1, wherein the first electrode is brought to a voltage in a range of −1 kV to −4 kV.

10. The smoke detector according to claim 1, wherein the second electrode is brought to a voltage in a range of −2V to −20V.

11. The smoke detector according to claim 1, wherein the distance between the first electrode and the second electrode is between 1 and 8 mm.

12. The smoke detector according to claim 1, wherein the distance between the second electrode and the third electrode is between 5 and 30 mm.

13. The smoke detector according to claim 1, wherein the ionization chamber is closed by a metal cover.

14. A device for detecting smoke comprising two smoke detectors according to claim 1, wherein the ionization chamber and the drift chamber of a second smoke detector are closed to entry of smoke particles and are configured to allow air from an environment of a first detector to enter; and wherein the electrical magnitude of the second smoke detector is used as a reference signal to correct the electrical magnitude of the first smoke detector for triggering the alarm.

15. A method for detecting smoke, comprising the steps of:

applying an electric potential between a first electrode and a second electrode that exceeds a critical electric potential value to generate a corona effect in the vicinity of the first electrode, which generates discharges that ionize air in an ionization chamber formed between the first electrode and the second electrode;

applying an electric potential between the second electrode and a third electrode to allow electric charges generated by ionization of the air in the ionization chamber entering a drift chamber through the second electrode to move from the second electrode towards the third electrode, an electric field generated between the second electrode and the third electrode is at least 100 times weaker than an electric field generated between the first electrode and the second electrode;

measuring an electrical magnitude representative of a speed of electrical charges between the second electrode and the third electrode and triggering an alarm when a change in the electrical magnitude is below a predetermined threshold.

* * * * *